US008840425B2

(12) United States Patent
Ku et al.

(10) Patent No.: US 8,840,425 B2
(45) Date of Patent: Sep. 23, 2014

(54) CONNECTOR APPARATUS AND ADAPTER APPARATUS WITH INDICATION FUNCTION

(71) Applicants: Ying-Ming Ku, Taoyuan (TW); Chun-Chieh Chen, Taoyuan (TW); Shun-Fa Hung, Taoyuan (TW)

(72) Inventors: Ying-Ming Ku, Taoyuan (TW); Chun-Chieh Chen, Taoyuan (TW); Shun-Fa Hung, Taoyuan (TW)

(73) Assignee: YFC-Boneagle Electric Co., Ltd., Taoyuan (TW)

( * ) Notice: Subject to any disclaimer, the term of this patent is extended or adjusted under 35 U.S.C. 154(b) by 140 days.

(21) Appl. No.: 13/622,565

(22) Filed: Sep. 19, 2012

(65) Prior Publication Data

US 2014/0080353 A1 Mar. 20, 2014

(51) Int. Cl.
*H01R 3/00* (2006.01)

(52) U.S. Cl.
USPC ..... 439/490

(58) Field of Classification Search
USPC ..... 323/223–226, 246, 275; 363/146; 439/488–490, 660, 668, 620.21, 439/620.23, 752.5; 324/66, 67, 538, 539, 324/542, 556; 340/815.45, 815.4, 310.11, 340/310.01, 310; 362/23.01, 23.02, 23.07; 710/17–19
See application file for complete search history.

(56) References Cited

U.S. PATENT DOCUMENTS 5,572,117 A * 11/1996 Yoon ..... 324/115
6,618,515 B2 * 9/2003 Kimura et al. ..... 385/15

* cited by examiner

*Primary Examiner* — Timothy J Dole
*Assistant Examiner* — Carlos Rivera-Perez
(74) *Attorney, Agent, or Firm* — Chun-Ming Shih; HDLS IPR Services

(57) ABSTRACT

A connector apparatus with indication function includes a first power line, a current-detecting resistor, a second power line, a ground line, a current-detecting unit, a first voltage comparator, a second voltage comparator, a first light-emitting unit, a second light-emitting unit, and a voltage division unit. The first light-emitting unit is lighting but the second light-emitting unit is not lighting when one side of the connector apparatus is connected to a computer and the other side of the connector apparatus is not connected to a smart 3C electronic product. The first light-emitting unit is not lighting but the second light-emitting unit is lighting when one side of the connector apparatus is connected to a computer and the other side of the connector apparatus is connected to a smart 3C electronic product.

6 Claims, 4 Drawing Sheets

CONNECTOR APPARATUS AND ADAPTER APPARATUS WITH INDICATION FUNCTION

BACKGROUND OF THE INVENTION

1. Field of the Invention

The present invention relates to a connector apparatus and an adapter apparatus, and especially relates to a connector apparatus with indication function and an adapter apparatus with indication function.

2. Description of Prior Art

A connector is a common electronic apparatus for joining electrical circuits together. For example, a connector can be connected between a computer and a smart 3C electronic product (for example, a mobile phone, an iPad, an iPod, a camcorder, or an audio and video transmission equipment), so that the smart 3C electronic product can be charged by the computer, or data can be transmitted between the smart 3C electronic product and the computer.

However, the disadvantage of current connector is that the connector does not have indication function when the connector is connected to a smart 3C electronic product (or a computer). Therefore, the user does not know that whether the connector is correctly connected to the smart 3C electronic product (or the computer) or not. The user does not know that whether the smart 3C electronic product is correctly charged by the computer or not. The user does not know that whether the data can be correctly transmitted between the smart 3C electronic product and the computer or not, either.

SUMMARY OF THE INVENTION

In order to solve the above-mentioned problems, an object of the present invention is to provide a connector apparatus with indication function.

In order to solve the above-mentioned problems, another object of the present invention is to provide an adapter apparatus with indication function.

In order to achieve the object of the present invention mentioned above, the connector apparatus with indication function of the present invention is applied to an apparatus with power supply and an electronic apparatus. The connector apparatus with indication function includes a first power line, a current-detecting resistor, a second power line, a ground line, a current-detecting unit, a first voltage comparator, a second voltage comparator, a first light-emitting unit, a second light-emitting unit, and a voltage division unit. One side of the current-detecting resistor is electrically connected to the first power line. The second power line is electrically connected to the other side of the current-detecting resistor. The ground line is arranged corresponding to the first power line. The current-detecting unit is electrically connected to the first power line, the second power line, and the ground line. A non-inverting input side of the first voltage comparator is electrically connected to the current-detecting unit. An inverting input side of the second voltage comparator is electrically connected to the non-inverting input side of the first voltage comparator. A non-inverting input side of the second voltage comparator is electrically connected to an inverting input side of the first voltage comparator. The first light-emitting unit is electrically connected to the first power line and the output side of the first voltage comparator. The second light-emitting unit is electrically connected to the first power line and the output side of the second voltage comparator. The voltage division unit is electrically connected to the first power line, the inverting input side of the first voltage comparator, and the ground line. When the apparatus with power supply is electrically connected to the first power line and the ground line, and the electronic apparatus is not electrically connected to the second power line and the ground line: A driving voltage is sent from the apparatus with power supply to the first power line. No current is flowing through the second power line detected by the current-detecting unit. No voltage is outputted from the current-detecting unit to the non-inverting input side of the first voltage comparator and the inverting input side of the second voltage comparator. Voltage is outputted from the voltage division unit to the inverting input side of the first voltage comparator and the non-inverting input side of the second voltage comparator. Zero voltage is outputted from the output side of the first voltage comparator to the first light-emitting unit, so the first light-emitting unit is lighting. The output side of the second voltage comparator is open circuit to the second light-emitting unit, so the second light-emitting unit is not lighting. When the apparatus with power supply is electrically connected to the first power line and the ground line, and the electronic apparatus is electrically connected to the second power line and the ground line: A driving voltage is sent from the apparatus with power supply to the first power line. Current is flowing through the second power line detected by the current-detecting unit. Voltage is outputted from the current-detecting unit to the non-inverting input side of the first voltage comparator and the inverting input side of the second voltage comparator. Voltage is outputted from the voltage division unit to the inverting input side of the first voltage comparator and the non-inverting input side of the second voltage comparator. The voltage outputted from the current-detecting unit is larger than the voltage outputted from the voltage division unit. The output side of the first voltage comparator is open circuit to the first light-emitting unit, so the first light-emitting unit is not lighting. Zero voltage is outputted from the output side of the second voltage comparator to the second light-emitting unit, so the second light-emitting unit is lighting.

In order to achieve the other object of the present invention mentioned above, the adapter apparatus with indication function of the present invention includes a current-detecting resistor, a current-detecting unit, a first voltage comparator, a second voltage comparator, a first light-emitting unit, a second light-emitting unit, and a voltage division unit. The current-detecting unit is electrically connected to the current-detecting resistor. A non-inverting input side of the first voltage comparator is electrically connected to the current-detecting unit. An inverting input side of the second voltage comparator is electrically connected to the non-inverting input side of the first voltage comparator. A non-inverting input side of the second voltage comparator is electrically connected to an inverting input side of the first voltage comparator. The first light-emitting unit is electrically connected to the output side of the first voltage comparator. The second light-emitting unit is electrically connected to the output side of the second voltage comparator. The voltage division unit is electrically connected to the inverting input side of the first voltage comparator.

DETAILED DESCRIPTION OF THE INVENTION

Figure 1:
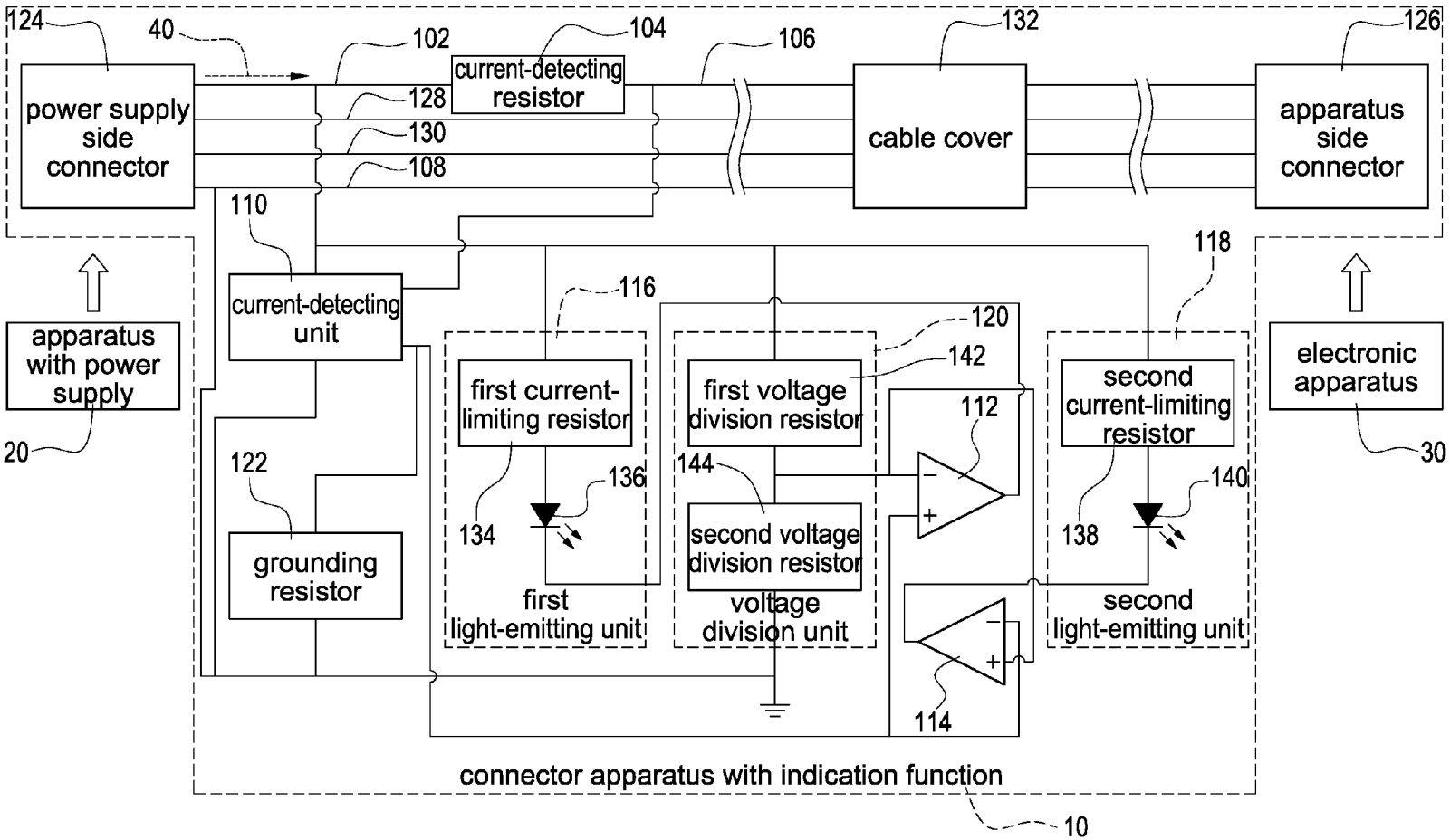
FIG. 1 shows a block diagram of the connector apparatus with indication function of the present invention.

FIG. 1 shows a block diagram of the connector apparatus with indication function of the present invention. A connector apparatus with indication function 10 is applied to an apparatus with power supply 20 and an electronic apparatus 30.

The connector apparatus with indication function 10 includes a first power line 102, a current-detecting resistor 104, a second power line 106, a ground line 108, a current-detecting unit 110, a first voltage comparator 112, a second voltage comparator 114, a first light-emitting unit 116, a second light-emitting unit 118, a voltage division unit 120, a grounding resistor 122, a power supply side connector 124, an apparatus side connector 126, a first data line 128, a second data line 130, and a cable cover 132.

The first light-emitting unit 116 includes a first current-limiting resistor 134 and a first light-emitting diode 136. The second light-emitting unit 118 includes a second current-limiting resistor 138 and a second light-emitting diode 140. The voltage division unit 120 includes a first voltage division resistor 142 and a second voltage division resistor 144.

The first power line 102 is electrically connected to one side of the current-detecting resistor 104, the current-detecting unit 110, the first light-emitting unit 116, the second light-emitting unit 118, the voltage division unit 120, the power supply side connector 124, the first current-limiting resistor 134, the second current-limiting resistor 138, and the first voltage division resistor 142.

The second power line 106 is electrically connected to the other side of the current-detecting resistor 104, the current-detecting unit 110, and the apparatus side connector 126. The ground line 108 is arranged corresponding to the first power line 102. The ground line 108 is electrically connected to the current-detecting unit 110, the voltage division unit 120, the grounding resistor 122, the power supply side connector 124, the apparatus side connector 126, and the second voltage division resistor 144.

A non-inverting input side of the first voltage comparator 112 is electrically connected to the current-detecting unit 110, an inverting input side of the second voltage comparator 114, and the grounding resistor 122. An inverting input side of the first voltage comparator 112 is electrically connected to a non-inverting input side of the second voltage comparator 114, the voltage division unit 120, the first voltage division resistor 142, and the second voltage division resistor 144. The output side of the first voltage comparator 112 is electrically connected to the first light-emitting unit 116 and the first light-emitting diode 136. The output side of the second voltage comparator 114 is electrically connected to the second light-emitting unit 118 and the second light-emitting diode 140.

The first data line 128 is arranged corresponding to the first power line 102. The first data line 128 is electrically connected to the power supply side connector 124 and the apparatus side connector 126. The second data line 130 is arranged corresponding to the first power line 102. The second data line 130 is electrically connected to the power supply side connector 124 and the apparatus side connector 126. The first power line 102, the second power line 106, the first data line 128, the second data line 130, and the ground line 108 are covered by the cable cover 132.

The first light-emitting diode 136 is electrically connected to the first current-limiting resistor 134. The second light-emitting diode 140 is electrically connected to the second current-limiting resistor 138. The power supply side connector 124 is used to connect to the apparatus with power supply 20. The apparatus side connector 126 is used to connect to the electronic apparatus 30.

The power supply side connector 124 is, for example, a universal serial bus (USB) connector. The apparatus with power supply 20 is, for example, a computer. The electronic apparatus 30 is, for example, a smart 3C electronic product (for example, a mobile phone, an iPad, an iPod, a camcorder, or an audio and video transmission equipment). The apparatus side connector 126 is, for example, a mini-USB. The first light-emitting diode 136 is, for example, a green light-emitting diode. The second light-emitting diode 140 is, for example, a red light-emitting diode.

When the apparatus with power supply 20 is electrically connected to the first power line 102 and the ground line 108, and the electronic apparatus 30 is not electrically connected to the second power line 106 and the ground line 108 (for example, one side of the connector apparatus with indication function 10 is connected to a computer, but the other side of the connector apparatus with indication function 10 is not connected to a smart 3C electronic product):

Firstly, a driving voltage 40 (for example 5 volts) is sent from the apparatus with power supply 20 to the first power line 102. No current is flowing through the second power line 106 detected by the current-detecting unit 110 (for example, no current is flowing through the second power line 106 because the connector apparatus with indication function 10 is not connected to a smart 3C electronic product). Then, no voltage is outputted from the current-detecting unit 110 to the non-inverting input side of the first voltage comparator 112 and the inverting input side of the second voltage comparator 114.

Voltage (divided from the driving voltage 40) is outputted from the voltage division unit 120 to the inverting input side of the first voltage comparator 112 and the non-inverting input side of the second voltage comparator 114. Therefore, the voltage of the inverting input side of the first voltage comparator 112 is larger than the voltage of the non-inverting input side of the first voltage comparator 112, and the voltage of the non-inverting input side of the second voltage comparator 114 is larger than the voltage of the inverting input side of the second voltage comparator 114.

Therefore, zero voltage is outputted from the output side of the first voltage comparator 112 to the first light-emitting unit 116, so the first light-emitting unit 116 is lighting. The output side of the second voltage comparator 114 is open circuit to the second light-emitting unit 118, so the second light-emitting unit 118 is not lighting.

When the apparatus with power supply 20 is electrically connected to the first power line 102 and the ground line 108, and the electronic apparatus 30 is electrically connected to the second power line 106 and the ground line 108 (for example, one side of the connector apparatus with indication function 10 is connected to a computer, and the other side of the connector apparatus with indication function 10 is connected to a smart 3C electronic product, so that the smart 3C electronic product is charged by the computer, or data can be transmitted between the smart 3C electronic product and the computer):

Firstly, a driving voltage 40 (for example 5 volts) is sent from the apparatus with power supply 20 to the first power line 102. Current is flowing through the second power line 106 detected by the current-detecting unit 110 (for example, the current is flowing through the second power line 106 because the connector apparatus with indication function 10 is connected to a smart 3C electronic product). Then, voltage is outputted from the current-detecting unit 110 to the non-inverting input side of the first voltage comparator 112 and the inverting input side of the second voltage comparator 114.

Voltage (divided from the driving voltage 40) is outputted from the voltage division unit 120 to the inverting input side of the first voltage comparator 112 and the non-inverting input side 114 of the second voltage comparator 114. The voltage outputted from the current-detecting unit 110 is larger than the voltage outputted from the voltage division unit 120. Therefore, the voltage of the non-inverting input side of the first voltage comparator 112 is larger than the voltage of the inverting input side of the first voltage comparator 112, and the voltage of the inverting input side of the second voltage comparator 114 is larger than the voltage of the non-inverting input side of the second voltage comparator 114. Therefore, the output side of the first voltage comparator 112 is open circuit to the first light-emitting unit 116, so the first light-emitting unit 116 is not lighting. Zero voltage is outputted from the output side of the second voltage comparator 114 to the second light-emitting unit 118, so the second light-emitting unit 118 is lighting.

Therefore, for example, the first light-emitting unit 116 is lighting but the second light-emitting unit 118 is not lighting when one side of the connector apparatus with indication function 10 is connected to a computer but the other side of the connector apparatus with indication function 10 is not connected to a smart 3C electronic product. The first light-emitting unit 116 is not lighting but the second light-emitting unit 118 is lighting when one side of the connector apparatus with indication function 10 is connected to a computer and the other side of the connector apparatus with indication function 10 is connected to a smart 3C electronic product. Therefore, the connection statuses between the connector apparatus, the smart 3C electronic product, and the computer may be judged easily by the user.

Figure 2:
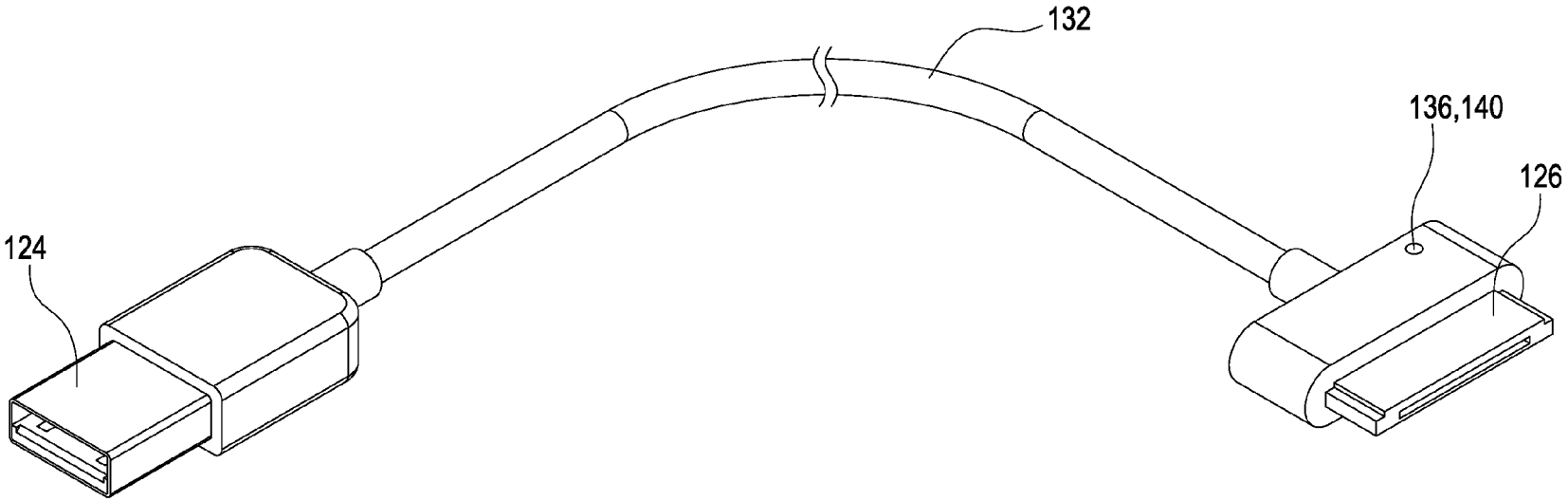
FIG. 2 shows an appearance diagram of an embodiment of the connector apparatus with indication function of the present invention.
Figure 3:
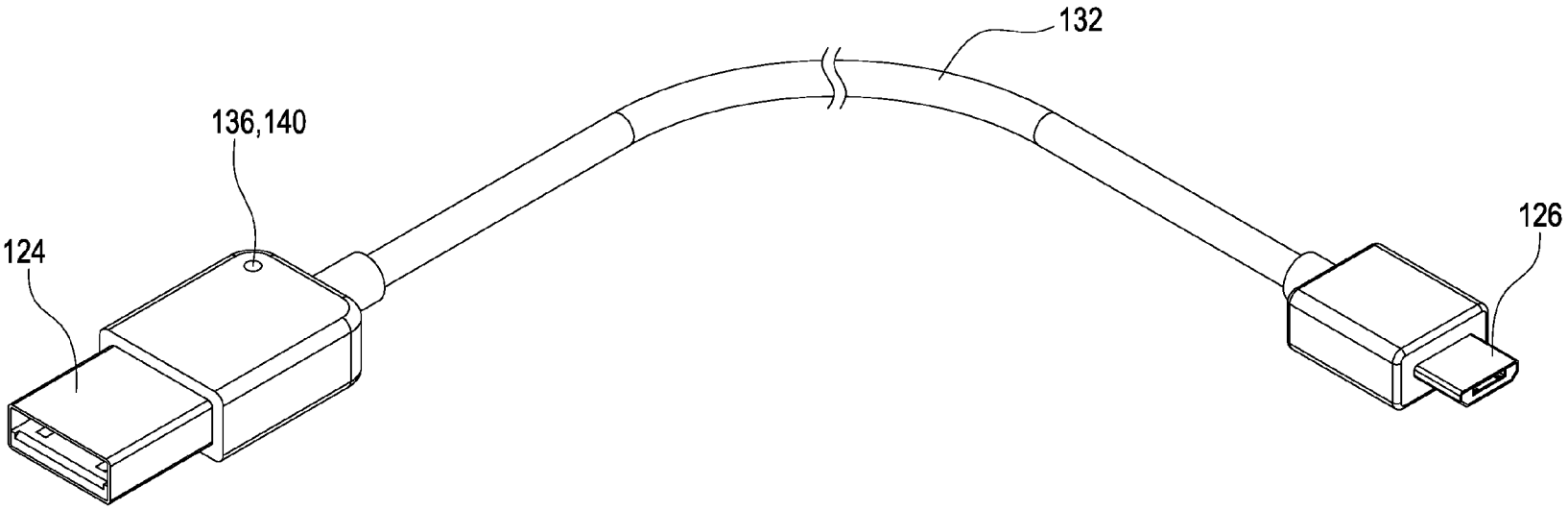
FIG. 3 shows an appearance diagram of another embodiment of the connector apparatus with indication function of the present invention.

FIG. 2 shows an appearance diagram of an embodiment of the connector apparatus with indication function of the present invention. The power supply side connector 124 is a USB connector. The apparatus side connector 126 is a 30 pins connector. FIG. 3 shows an appearance diagram of another embodiment of the connector apparatus with indication function of the present invention. The power supply side connector 124 is one type of connector while the apparatus side connector 126 is another type of connector. In FIG. 2 and FIG. 3, the first light-emitting diode 136 and the second light-emitting diode 140 are integrated as a dual-color light-emitting diode.

Figure 4:
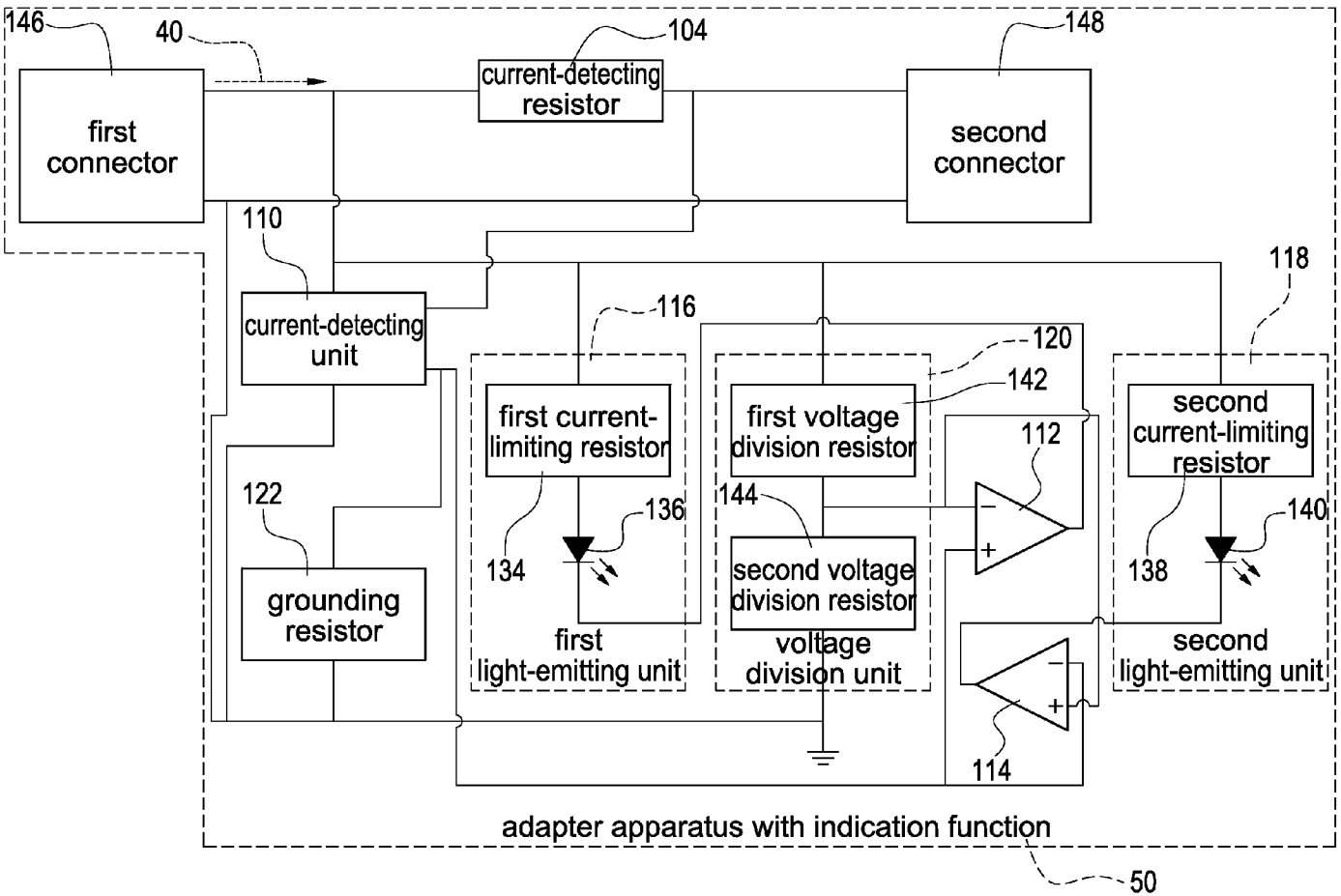
FIG. 4 shows a block diagram of the adapter apparatus with indication function of the present invention.

FIG. 4 shows a block diagram of the adapter apparatus with indication function of the present invention. A adapter apparatus with indication function 50 includes a current-detecting resistor 104, a current-detecting unit 110, a first voltage comparator 112, a second voltage comparator 114, a first light-emitting unit 116, a second light-emitting unit 118, a voltage division unit 120, a grounding resistor 122, a first connector 146, and a second connector 148.

The first light-emitting unit 116 includes a first current-limiting resistor 134 and a first light-emitting diode 136. The second light-emitting unit 118 includes a second current-limiting resistor 138 and a second light-emitting diode 140. The voltage division unit 120 includes a first voltage division resistor 142 and a second voltage division resistor 144.

The electrical connections between these components and the descriptions of the contents in FIG. 4 are omitted because they are similar to FIG. 1 and the contents mentioned above.

The adapter apparatus with indication function 50 may be arranged between a computer and an extended line adapter (for example, the first connector 146 is connected to the computer, and the second connector 148 is connected to the extended line adapter), then the extended line adapter is connected to a smart 3C electronic product. Or, the adapter apparatus with indication function 50 may be arranged between a smart 3C electronic product and an extended line adapter (for example, the first connector 146 is connected to the smart 3C electronic product, and the second connector 148 is connected to the extended line adapter), then the extended line adapter is connected to a computer.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A connector apparatus with indication function, the connector apparatus applied to an apparatus with power supply and applied to an electronic apparatus, the connector apparatus including:

a first power line;

a current-detecting resistor, one side of the current-detecting resistor being electrically connected to the first power line;

a second power line electrically connected to the other side of the current-detecting resistor;

a ground line arranged corresponding to the first power line;

a current-detecting unit electrically connected to the first power line, the second power line, and the ground line;

a first voltage comparator, a non-inverting input side of the first voltage comparator being electrically connected to the current-detecting unit;

a second voltage comparator, an inverting input side of the second voltage comparator being electrically connected to the non-inverting input side of the first voltage comparator, a non-inverting input side of the second voltage comparator being electrically connected to an inverting input side of the first voltage comparator;

a first light-emitting unit electrically connected to the first power line and the output side of the first voltage comparator;

a second light-emitting unit electrically connected to the first power line and the output side of the second voltage comparator; and a voltage division unit electrically connected to the first power line, the inverting input side of the first voltage comparator, and the ground line, wherein when the apparatus with power supply is electrically connected to the first power line and the ground line, and the electronic apparatus is not electrically connected to the second power line and the ground line:

a driving voltage is sent from the apparatus with power supply to the first power line; no current is flowing through the second power line detected by the current-detecting unit; no voltage is outputted from the current-detecting unit to the non-inverting input side of the first voltage comparator and the inverting input side of the second voltage comparator; voltage is outputted from the voltage division unit to the inverting input side of the first voltage comparator and the non-inverting input side of the second voltage comparator; zero voltage is outputted from the output side of the first voltage comparator to the first light-emitting unit, so the first light-emitting unit is lighting; the output side of the second voltage comparator is open circuit to the second light-emitting unit, so the second light-emitting unit is not lighting;

wherein when the apparatus with power supply is electrically connected to the first power line and the ground line, and the electronic apparatus is electrically connected to the second power line and the ground line:

a driving voltage is sent from the apparatus with power supply to the first power line; current is flowing through the second power line detected by the current-detecting unit; voltage is outputted from the current-detecting unit to the non-inverting input side of the first voltage comparator and the inverting input side of the second voltage comparator; voltage is outputted from the voltage division unit to the inverting input side of the first voltage comparator and the non-inverting input side of the second voltage comparator; the voltage outputted from the current-detecting unit is larger than the voltage outputted from the voltage division unit; the output side of the first voltage comparator is open circuit to the first light-emitting unit, so the first light-emitting unit is not lighting; zero voltage is outputted from the output side of the second voltage comparator to the second light-emitting unit, so the second light-emitting unit is lighting.

2. The connector apparatus with indication function in claim 1, further including:

a grounding resistor electrically connected to the non-inverting input side of the first voltage comparator and the ground line.

3. The connector apparatus with indication function in claim 2, wherein the first light-emitting unit includes:

a first current-limiting resistor electrically connected to the first power line; and a first light-emitting diode electrically connected to the first current-limiting resistor and the output side of the first voltage comparator, wherein the second light-emitting unit includes:

a second current-limiting resistor electrically connected to the first power line; and a second light-emitting diode electrically connected to the second current-limiting resistor and the output side of the second voltage comparator.

4. The connector apparatus with indication function in claim 3, wherein the voltage division unit includes:

a first voltage division resistor electrically connected to the first power line and the inverting input side of the first voltage comparator; and a second voltage division resistor electrically connected to the ground line and the inverting input side of the first voltage comparator.

5. The connector apparatus with indication function in claim 4, further including:

a power supply side connector electrically connected to the first power line and the ground line; and an apparatus side connector electrically connected to the second power line and the ground line, wherein the power supply side connector is used to connect to the apparatus with power supply; the apparatus side connector is used to connect to the electronic apparatus.

6. The connector apparatus with indication function in claim 5, further including:

a first data line arranged corresponding to the first power line and electrically connected to the power supply side connector and the apparatus side connector;

a second data line arranged corresponding to the first power line and electrically connected to the power supply side connector and the apparatus side connector; and a cable cover covering the first power line, the second power line, the first data line, the second data line, and the ground line.

* * * * *